United States Patent [19]

Ruf

[11] 4,090,824

[45] May 23, 1978

[54] ROTARY PISTON ENGINE PISTON HAVING AN INTERNAL SEAL

[75] Inventor: Max Ruf, Obereisesheim, Germany

[73] Assignee: Audi NSU Auto Union Aktiengesellschaft, Germany

[21] Appl. No.: 785,068

[22] Filed: Apr. 6, 1977

[30] Foreign Application Priority Data

Apr. 9, 1976 Germany ..... 2615549

[51] Int. Cl.[2] ..... F01C 19/12; F16J 9/16; B23P 15/08

[52] U.S. Cl. ..... 418/142; 29/156.6; 277/195

[58] Field of Search ..... 418/142; 277/193, 194, 277/195, 198, 235 R; 29/156.6

[56] References Cited

U.S. PATENT DOCUMENTS

| | | | |
|---|---|---|---|
| 2,577,022 | 12/1951 | Lieberherr | 277/193 X |
| 3,456,624 | 7/1969 | Okamoto | 418/142 |
| 3,782,869 | 1/1974 | Steinwart et al. | 418/142 |

FOREIGN PATENT DOCUMENTS

| | | | |
|---|---|---|---|
| 906,866 | 2/1946 | France | 277/198 |

*Primary Examiner*—Carlton R. Croyle
*Assistant Examiner*—Leonard E. Smith
*Attorney, Agent, or Firm*—Kane, Dalsimer, Kane, Sullivan and Kurucz

[57] ABSTRACT

Internal seal for the piston of a rotary piston engine. The seal includes a slide ring with an annular scraping edge of L-shaped cross-section with an axial flange and a flange extending radially outward. The slide ring includes an axially extending ring with one face together with its inner periphery forming the scraping edge. The slide ring includes a radially extending ring with its inner periphery shrunk onto the outer periphery of the axial ring near the one face. The axial ring consists of a material having a smaller coefficient of heat expansion than the radial ring.

3 Claims, 5 Drawing Figures

ROTARY PISTON ENGINE PISTON HAVING AN INTERNAL SEAL

BACKGROUND OF THE INVENTION

The invention relates to an internal seal for the piston of a rotary piston engine including a slide ring having an annular scraping edge. The ring is of L-shaped cross-section with an axial flange and a flange extending radially outward.

In pistons of the type described, the function of the internal seal, arranged in an annular groove, is to seal the rotating piston against the face of the end part so as to prevent passage of coolant or lubricant radially outward along the face into the working chamber. For this purpose, the internal seal has a slide ring with a scraping edge, generally made sharp-edged radially inward and provided with a somewhat beveled relief radially outward. The function of the ring is essentially to pass over any oil adhering to the face in the centrifugal motion of the scraper ring radially outward and to scrape it off and feed it back radially inward in the centripetal motion.

Now it has been found, however, that the sharp scraping edge in contact with the face in known slide rings, especially during unavoidable periods of running cold, will be ground down to an annular area in the course of time. A scraping edge ground down in this way will impair the scraping action very substantially with the result that the slide ring can float on the oil adhering to the face in both its outward and inward radial motions, so that the slide ring ceases to perform its proper function satisfactorily, and oil consumption is increased.

SUMMARY OF THE INVENTION

The object of the invention is to provide an internal seal of the type initially mentioned with its slide ring so designed as to retain its sharp scraping edge even over a long period of time.

This object is accomplished according to the invention in that the slide ring is composed of a ring extending axially, one face together with the inner periphery forming the scraping edge, and a ring extending radially, its inner periphery being shrunk onto the outer periphery of the axial ring near its said face. The axial ring consists of a material having a smaller coefficient of heat expansion than the radial ring.

By virtue of the construction according to the invention when the slide ring is heated the portion of the axial ring encircled by the radial ring and therefore under stress is able to expand more, following the linear expansion of the radial ring, than the remaining portion of the axial ring. As a result, the scraping edge is drawn radially inward when running cold, and its face extending radially outward, which together with the inner periphery forms the scraping edge, is in partial contact with the neighboring end wall and scrubs agains it. Since the engine is in any event operating at small load and low speed when running cold, such a blunt contact of the slide ring has no adverse effect on oil consumption, but has the advantage that the scraping edge is not only subjected to a self sharpening action but at the same time protected against wear. Upon heating, however, a surprising effect occurs; the face or relief surface can address the end wall obliquely, since the region of the scraping edge can expand farther radially outward than the remaining portion of the axial ring, so that in this condition the scraping edge sharpened when running cold makes contact and thus ensures the scraping action of the slide ring.

In the case of a slide ring provided on its inner periphery at least in the region of the scraping edge, with a hard abrasion-resistant layer, this layer will have a crackled texture. This serves to prevent the layer from restraining the expansion of the axial ring as described.

The invention relates also to a method of producing the slide ring according to the invention, wherein the radial ring is so shrunk onto the axial ring that a constriction of the inside diameter of the axial ring occurs at the end forming the scraping edge, to be reversed at least in part when the slide ring is heated to operating temperature.

In practice, the dimensional difference between the outside diameter of the axial ring at the point of accommodation of the radial ring and the inside diameter of the radial ring is so chosen that after the ensuing contraction of the two rings, a stress is set up in this region of the axial ring. The stress attains such a value that this portion of the axial ring is able firstly to expand radially outward together with the radial ring, corresponding to the greater expansion of the latter, farther than the remaining portion of the axial ring, upon heating, and secondly to contract back to its initial position without losing its tension and stability of shape, when the operating temperature decreases once more.

An embodiment of the invention will now be described in more detail with reference to the drawings by way of example.

DESCRIPTION OF THE PREFERRED EMBODIMENT

Figure 1:
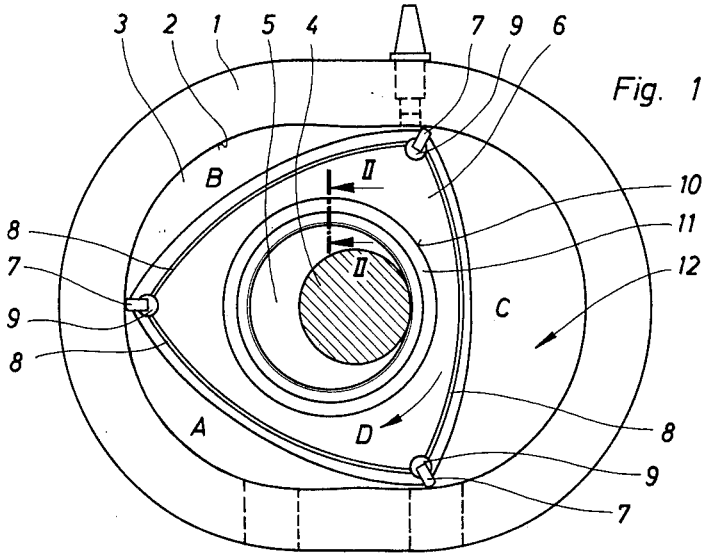
FIG. 1 shows a rotary piston engine of trochoid type having a triangular piston in schematic representation with one end part removed.

Reference is made first to FIG. 1 representing a rotary piston engine of trochoid type having a housing consisting essentially of a shell 1 with biarcuate inner surface 2 and two parallel end parts 3 and traversed by an eccentric shaft 4 on whose eccentric 5 a triangular piston 6 is rotatably mounted. The piston 6 bears sealing strips 7 at its vertices, constantly sliding along the inner surface 2 of the shell as the piston revolves in the direction of the arrow D, thereby forming working chambers A, B and C of variable volume and sealing them off from each other. For a lateral seal between piston 6 and end parts 3 each end wall of the piston is provided with bowed sealing strips 8 extending between pairs of sealing strips 7 and connected to them by sealing pins 9.

To prevent leakage of coolant or lubricant radially outward from the region of the shaft 4 against sealing elements 7, 8 and 9 and into the working chambers A, B and C, each end wall of the piston is further provided with an axially movable internal seal 11 in an annular groove 10 cooperating with the wall 12 of the neighboring end part 3. As the piston 6 revolves in the direction of the arrow D, the inner seal 11 follows the motion executed by the piston 6, scraping off any oil adhering to the end wall 12 and returning it radially inward.

Figure 2:
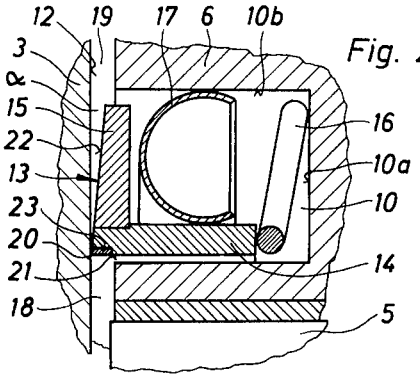
FIG. 2 shows a portion of a longitudinal section of one end wall of the piston with an internal seal and slide ring according to the invention at the line II—II in FIG. 1, together with a portion of the neighboring end part to a larger scale.

As is seen in FIG. 2, the inner seal 11 of this embodiment by way of example consists of a slide ring 13 of L-shaped cross-section having an axial flange 14 and a flange 15 extending radially outward. The slide ring 13 is sprung against the end wall 12 by way of its axial flange 14 by an annular spring 16 bearing against the floor 10*a* of the annular groove 10. It is sealed inside the annular groove 10 by an elastic sealing ring 17, for example of metal, inserted under radial prestresses between the radially outer wall 10*b* of the groove and axial flange 14. The result is the prevention of leakage of coolant or lubricant from the space 18 in the region of shaft 4 and eccentric 5 both radially outward along the end wall 12 and through the annular groove 10 into the space 19 and thence past the sealing elements 7, 8 and 9 shown in FIG. 1 into the working chambers.

For this purpose, the slide ring 13 has an annular scraping edge 20, sharp at the radially inner periphery 21 and provided radially outward with a relief 22 making an angle $\alpha$ with the end wall 12, so that the slide ring 13 can pass over oil adhering to the end wall 12 in its radially outward motion, and scrape it off and return it to the space 18 in its radially inward motion. To improve the wear resistance of the scraping edge 20, constantly pressed against the end wall 12 and sliding upon it, the inner periphery 21 of the slide ring 13 is provided at least in the region nearest the end wall 12, the region of the scraping edge 20 with a hard abrasion-resistant layer 23.

Figure 3:
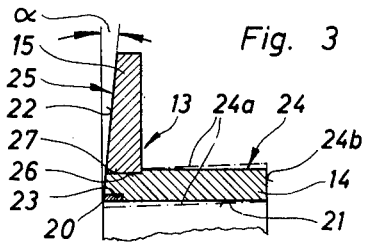
FIG. 3 shows a cross-section of the slide ring according to the invention in the internal seal of FIG. 2.

FIG. 3 shows that the slide ring 13 according to the invention is composed of a ring 24 extending axially and a ring 25 extending radially, the inner periphery 26 of the radial ring 25 being shrunk onto the outer periphery 27 of that end of the axial ring 24 on which the scraping edge 20 is located. The axial ring 24 thus forms the axial flange 14 and the radial ring 25 forms the radial flange 15 of the slide ring 13. For better retention the rings 24 and 25 may be joined together at their mutual points of meeting, for example by electron beam welding.

Before shrink assembly, however, the radial ring 25, at least on its inner periphery 26 and the axial ring 24, at least at the point of accommodation of the radial ring 25, are finished to a dimensional difference such that the outer periphery 27 of the axial ring 24 at the point of accommodation of the radial ring 25 is for example — on the diameter —0.6 per mil larger than the inner periphery 26 of the radial ring 25. In the case of an inner periphery 26 with a diameter of 130 mm, the oversize will be for example 0.08 mm on the diameter. As a result of this oversize, a stress directed radially inward will be set up in the axial ring 24 after the radial ring 25 has been shrunk on, in the region where the scraping edge 20 is located. This will deform the axial ring 24 to such an extent that the inner periphery 21 is smaller in diameter by the amount of the oversize in the region of the scraping edge 20 than at the other end 24*b* of flange 14, as indicated by the dot-dash line 24*a*. At the same time, however, the internal stress in the slide ring 13 is gauged so that when the slide ring 13 is heated, the region of the scraping edge 20 in the axial ring 24 expands radially outward just as far matching the expansion of the radial ring 25, as the radial ring 25 itself with its greater coefficient of expansion, while in the case of a decline in operating temperature, this region will be deformed back into its original position. Since the portion of axial ring 24 starting from the other end 24*b* of the scraping edge 20, and not under stress, is not able to expand as much when the slide ring 13 is heated as the region encircled by the radial ring 25, the region of the scraping edge 20 will move radially outward considerably more than the said other end 24*b*, thus simultaneously enlarging the angle $\alpha$ at the surface 22. What advantageous effects these properties of the slide ring 13 according to the invention have specifically on the scraping edge 20 is illustrated in more detail in FIGS. 4 and 5.

Figure 4:
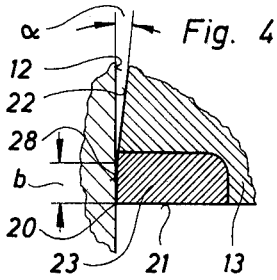
FIG. 4 shows a cross-section of a portion of a slide ring.

In the portion shown to a still larger scale in FIG. 4, the slide ring 13 occupies a position corresponding to cold operation of the engine. Since in this condition, the region of the scraping edge 20 is under stress, but fairly severe friction occurs at the scraping edge 20 because the oil film is as yet inadequate, an annular contact area 28 of width *b* is formed on the relief surface 22, and may gradually widen with increasing service time and extend as far as into the base material of the slide ring 13. This contact area 28, firstly, protects the scraping edge 20 proper from wear; secondly, a self-sharpening effect, constantly sharpening the scraping edge develops between the inner periphery 21 and the annular contact area 28. This annular contact of slide ring 13 with wall 12 desirable for the sake of a sharp scraping edge 20, does not adversely affect oil consumption owing to small load and low speeds in this operating condition.

Figure 5:
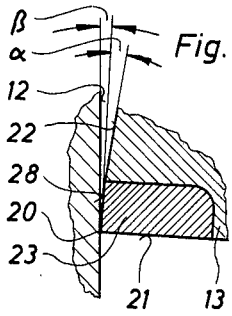
FIG. 5 shows a cross-section like that of FIG. 4 with slide ring in changed position.

FIG. 5 shows the portion of slide ring 13 heated and -as described with reference to FIG. 3 — deformed. The angle $\alpha$ between wall 12 and surface 22 has increased in this condition by an angle $\beta$, and instead of the annular contact area 28, the scraping edge 20 is now the line of direct contact with the wall 12. In this setting the scraping edge 20 is subject only to the usual extremely slight thermal wear encountered in this operating condition, since the wear pattern in the form of annular contact area 28 comes about for the most part during cold operation. Neither in this setting does the slide ring 13 float on the oil adhering to the wall, but its surface 22 and the annular contact area 28 pass over the oil and the scraping edge 20 scrapes it off radially inward, being thus fully operative.

The abrasion resistant layer 23 may for example consist of a hard chromium alloy. The use of such a layer distinguished by special wear resistance is possible because a layer of hard chromium alloy may as is known, be produced with microcracks formed in the course of galvanic, thermal or mechanical treatment. This crackle texture extending down to the base material of the slide ring, divides the layer into numerous mosaic-like chips, all, however, firmly joined to the base material. Despite the differential coefficient of heat expansion between the base material of ring 13 and the abrasion resistant layer 23, the slide ring 13 is thus able to expand without occurrence of thermal stresses or unwanted deformations of ring 13, and without the possibility that bits of the mosaic chips of the abrasion resistant layer 23 may break out. Through the construction according to the invention, the slide ring 13 acquires properties adding substantially to the life of the scraping edge.

What is claimed is:

1. Internal seal for the piston of a rotary piston engine comprising; a slide ring with an annular scraping edge of L-shaped cross-section with an axial flange and a flange extending radially outward, the slide ring including an axially extending ring with one face together with its inner periphery forming the scraping edge, the slide ring including a radially extending ring with its inner periphery shrunk onto the outer periphery of the axial ring near the one face, and the axial ring consisting of material having a smaller coefficient of heat expansion than the radial ring.

2. Internal seal according to claim 1, wherein the inner periphery of the slide ring, at least in the region of the scraping edge, is provided with a hard abrasion-resistant layer possessing a crackled textured.

3. Internal seal according to claim 1, wherein the radial ring is sufficiently shrunk onto the axial ring so that a constriction of the inner diameter of the axial ring occurs at the end forming the scraping edge, the constriction being at least partially reversed when the slide ring is heated to operating temperature.

* * * * *